US008505907B2

(12) United States Patent
Herrmann et al.

(10) Patent No.: US 8,505,907 B2
(45) Date of Patent: Aug. 13, 2013

(54) METHOD AND APPARATUS FOR DETERMINING THE POSITION OF ADJUSTABLE FEEDER TRAY SIDE GUIDES IN AN IMAGE PRODUCTION DEVICE

(75) Inventors: Douglas K. Herrmann, Webster, NY (US); Martin E. Hoover, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/008,135

(22) Filed: Jan. 18, 2011

(65) Prior Publication Data

US 2012/0181746 A1 Jul. 19, 2012

(51) Int. Cl.
*B65H 1/00* (2006.01)

(52) U.S. Cl.
USPC ..... 271/171

(58) Field of Classification Search
USPC ..... 271/171; 340/540
See application file for complete search history.

(56) References Cited

U.S. PATENT DOCUMENTS

| | | | | |
|---|---|---|---|---|
| 6,264,195 | B1 * | 7/2001 | Hoberock et al. | 271/226 |
| 6,619,656 | B2 * | 9/2003 | Guddanti et al. | 271/171 |
| 7,231,172 | B2 * | 6/2007 | Park | 399/389 |
| 2003/0141652 | A1 * | 7/2003 | Guddanti et al. | 271/171 |
| 2006/0255531 | A1 * | 11/2006 | Azzopardi et al. | 271/171 |
| 2008/0044216 | A1 * | 2/2008 | Kim | 400/708 |
| 2011/0260392 | A1 * | 10/2011 | Herrmann et al. | 271/207 |

FOREIGN PATENT DOCUMENTS

JP 57-67439 * 4/1982

OTHER PUBLICATIONS

Martin E. Hoover and Douglas K. Herrmann; "Method and Apparatus for Determining the Amount of Media on an Elevator That Supports a Media Stack in an Image Production Device"; U.S. Appl. No. 12/909,486, filed Oct. 21, 2010.

Douglas K. Herrmann and Martin E. Hoover; "Horizontal Sensor and Variable Pattern for Detecting Vertical Stacker Position"; U.S. Appl. No. 12/766,323, filed Apr. 23, 2010.

Martin Richard Walsh; "Print System With Linear Encoder for Tray Print Media Sizing"; U.S. Appl. No. 12/699,917, filed Feb. 4, 2010.

* cited by examiner

*Primary Examiner* — Kaitlin Joerger
(74) *Attorney, Agent, or Firm* — Ronald E. Prass, Jr.; Prass LLP

(57) ABSTRACT

A method and apparatus for determining the position of adjustable feeder tray side guides in an image production device is disclosed. The method may include detecting an amount of a continuously variable sloped shape marker, determining a position of the adjustable feeder tray side guide of a feeder tray based on the detected amount of the continuously variable sloped shape marker, and outputting the determined position of the adjustable feeder tray side guide of a feeder tray to a user interface of the image production device.

12 Claims, 5 Drawing Sheets

METHOD AND APPARATUS FOR DETERMINING THE POSITION OF ADJUSTABLE FEEDER TRAY SIDE GUIDES IN AN IMAGE PRODUCTION DEVICE

BACKGROUND

Disclosed herein is a method for determining the position of adjustable feeder tray side guides in an image production device, as well as corresponding apparatus and computer-readable medium.

Feeder tray side guides available on different conventional feeder systems currently rely on, operator placement (no sensing), discreet sensing (multiple point sensors) or encoder type controls (linear or rotary). These methods limit the ability of a feeder tray system to accurately determine the side guide locations and therefore the width of the media size. Additionally, in the case of the encoder solutions, a homing routine is required during loading, unload and/or shutdown.

There are issues with each of the conventional feeder system designs with regard to side guide position feedback, such as:

No sensing: This method does not provide any feedback to the system.

Discreet sensing: This design is able to provide only an approximate location.

This is due to the non-continuous nature of the sensing design.

Encoder sensing: This design can provide more accuracy but requires a homing step each time the tray has been moved to confirm the guides have not moved since the last homing.

SUMMARY

A method and apparatus for determining the position of adjustable feeder tray side guides in an image production device is disclosed. The method may include detecting an amount of a continuously variable sloped shape marker, determining a position of the adjustable feeder tray side guide of a feeder tray based on the detected amount of the continuously variable sloped shape marker, and outputting the determined position of the adjustable feeder tray side guide of a feeder tray to a user interface of the image production device.

DETAILED DESCRIPTION

Figure 1:
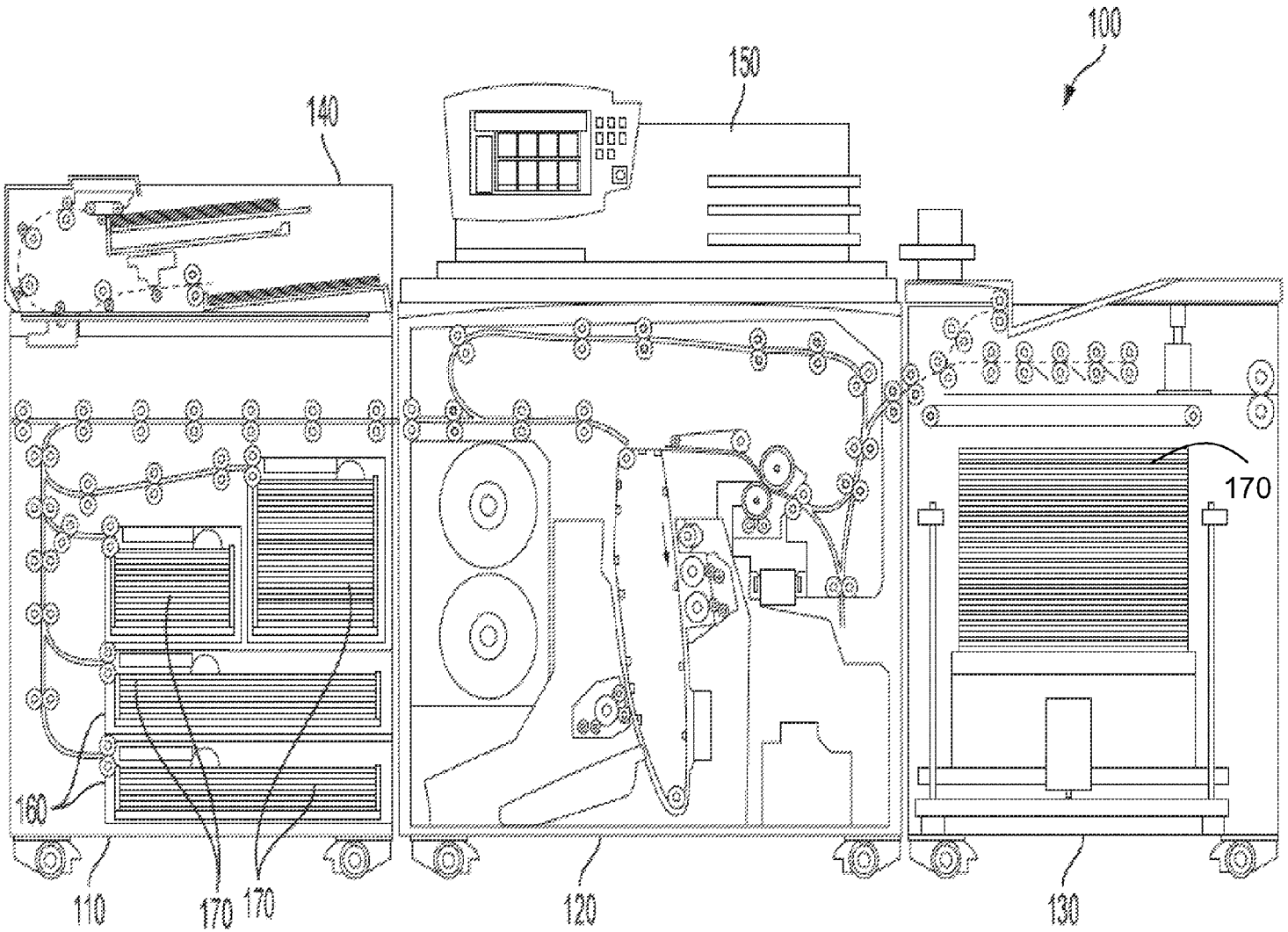
FIG. 1 is an exemplary diagram of an image production device in accordance with one possible embodiment of the disclosure.

Aspects of the embodiments disclosed herein relate to a method for determining the position of adjustable feeder tray side guides in an image production device, as well as corresponding apparatus and computer-readable medium.

The disclosed embodiments may include a method for determining the position of adjustable feeder tray side guides in an image production device. The method may include detecting an amount of a continuously variable sloped shape marker, determining a position of the adjustable feeder tray side guide of a feeder tray based on the detected amount of the continuously variable sloped shape marker, and outputting the determined position of the adjustable feeder tray side guide of a feeder tray to a user interface of the image production device.

The disclosed embodiments may further include an image production device that may include a user interface that displays information to a user, a continuously variable sloped shape marker, an adjustable feeder tray side guide position sensor that detects an amount of a continuously variable sloped shape marker, and an adjustable feeder tray side guide position determination unit that determines a position of the adjustable feeder tray side guide of a feeder tray based on the detected amount of the continuously variable sloped shape marker, and output the determined position of the adjustable feeder tray side guide of a feeder tray to the user interface.

The disclosed embodiments may further include a computer-readable medium storing instructions for controlling a computing device in determining the position of adjustable feeder tray side guides in an image production device. The instructions may include detecting an amount of a continuously variable sloped shape marker, determining a position of the adjustable feeder tray side guide of a feeder tray based on the detected amount of the continuously variable sloped shape marker, and outputting the determined position of the adjustable feeder tray side guide of a feeder tray to a user interface of the image production device.

The disclosed embodiments may concern an array sensor (e.g., a low-cost contact image sensor (CIS), etc.) that may be used to determine the position of adjustable feeder tray side guides in an image production device. The absolute location of the adjustable feeder tray side guides may be determined directly from the sensor readout. However, there is a cost issue with using a single or stitched sensor system able to span the entire tray. This distance can be considerable (e.g., 18" or more) and may vary with the image production device model.

As such, the disclosed embodiments determine absolute and accurate side guide location using a small CIS sensor such as an A6 (100 mm) or A8 (54 mm). This process significantly reduces the cost and complexity associated with using a longer CIS system, but provides a continuous and accurate measurement based on the capabilities of a low cost CIS sensor. By installing a small sensor array (such as a CIS (Contact Image Sensor)) at approximately a right angle to a continuously variable shape such as a triangle absolute and accurate side guide positional data for any width paper can be determined. Additionally, this solution provides a low complexity and low cost system while increasing performance and positional accuracy.

With the sensor array mounted perpendicular to a continuously varying shaped target on the feeder tray or feeder frame, the sensor can be much shorter then the width of the media or side guide travel. This sensor/target system creates an optical reduction to reduce the sensor size requirement while providing accurate positioning data.

By mounting the CIS on the feeder perpendicular to a triangle image (decal) on the tray, the sensor's inherent accuracy can be used to accurately identify position and thus media size without the expense or complexity associated with using an array sensor capable of spanning the whole range of travel.

This concept is applicable to many applications involving media feeding trays where detection of the size media is of importance such as printing and copying. In the iGen feeder for example the system requires several linked sensors to be used in an attempt to provide some side guide positional data. Currently this design is still not capable of detecting side guide location absolutely so an algorithm is needed to identify approximate location using the discreet sensors.

In this manner, the disclosed embodiments solve the issue of identifying side guide position/media size and at the same time reduces complexity, and improves performance by giving an accurate low cost method of identifying media size.

The benefits of the adjustable feeder tray side guide position determination apparatus and method of the disclosed embodiments include:

- Better sensor availability due to reduced length, complexity and cost.
- Accurate positional/paper size feedback.
- Elimination of homing operation during run and after unload or shutdown.
- Low cost/high accuracy solution for feeder trays for both low cost systems through high end systems.

One possible embodiment in which the CIS is mounted on the adjustable feeder tray side guide so that it detects a solid or segmented positional reference scale on the frame (e.g., a decal, etchings, indentations, etc., attached to a frame in the feeder section of the image production device). The sensor's inherent ability to measure linear position over a limited range may be used to identify location by the amount of the continuously variable sloped shape marker. The sensor may also able to detect additional identification marks of various size or shape allowing it to cover a larger span as a series of segmented zones. Using the sensor in this way may allow the inherent high resolution to be used over the full range of travel by being able to detect which zone or segment it is looking at then measuring actual position relative to the index mark for each particular zone.

FIG. 1 is an exemplary diagram of an image production device 100 in accordance with one possible embodiment of the disclosure. The image production device 100 may be any device or combination of devices that may be capable of making image production documents (e.g., printed documents, copies, etc.) including a copier, a printer, a facsimile device, and a multi-function device (MFD), for example.

The image production device 100 may include an image production section 120, which includes hardware by which image signals are used to create a desired image, as well as a stand-alone feeder section 110, which stores and dispenses sheets on which images are to be printed, and an output section 130, which may include hardware for stacking, folding, stapling, binding, etc., prints which are output from the marking engine. If the image production device 100 is also operable as a copier, the image production device 100 may further include a document feeder 140, which operates to convert signals from light reflected from original hard-copy image into digital signals, which are in turn processed to create copies with the image production section 120. The image production device 100 may also include a local user interface 150 for controlling its operations, although another source of image data and instructions may include any number of computers to which the printer is connected via a network.

With reference to feeder section 110, the section may include any number of feeder trays 160, each of which stores a media stack 170 or print sheets ("media") of a predetermined type (size, weight, color, coating, transparency, etc.) and may include a feeder to dispense one of the sheets therein as instructed. Certain types of media may require special handling in order to be dispensed properly. For example, heavier or larger media may desirably be drawn from a media stack 170 by use of an air knife, fluffer, vacuum grip or other application (not shown in the Figure) of air pressure toward the top sheet or sheets in a media stack 170. Certain types of coated media may be advantageously drawn from a media stack 170 by the use of an application of heat, such as by a stream of hot air (not shown in the Figure). Sheets of media drawn from a media stack 170 on a selected feeder tray 160 may then be moved to the image production section 120 to receive one or more images thereon. Then, the printed sheet is then moved to output section 130, where it may be collated, stapled, folded, punched, etc., with other media sheets in manners familiar in the art.

Note that the image production device 100 may be or may include a stand-alone feeder section 110 (or module) and/or a stand-alone output (finishing) section 130 (or module within the spirit and scope of the disclosed embodiments.

Figure 2:
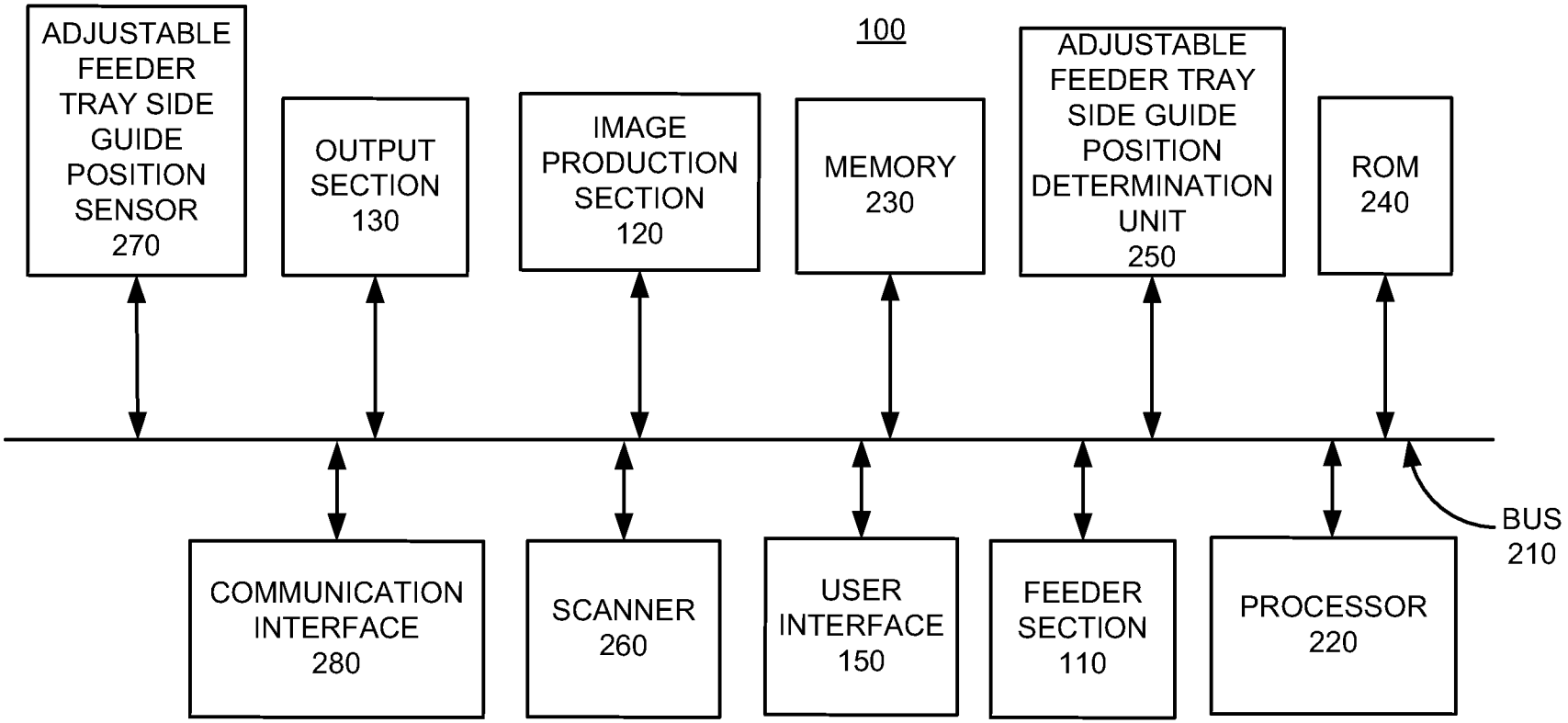
FIG. 2 is an exemplary block diagram of the image production device in accordance with one possible embodiment of the disclosure.

FIG. 2 is an exemplary block diagram of the image production device 100 in accordance with one possible embodiment of the disclosure. The image production device 100 may include a bus 210, a processor 220, a memory 230, a read only memory (ROM) 240, a adjustable feeder tray side guide position determination unit 250, a feeder section 110, an output section 130, a user interface 150, a scanner 260, an adjustable feeder tray side guide position sensor 270, a communication interface 280, and an image production section 120. Bus 210 may permit communication among the components of the image production device 100.

Processor 220 may include at least one conventional processor or microprocessor that interprets and executes instructions. Memory 230 may be a random access memory (RAM) or another type of dynamic storage device that stores information and instructions for execution by processor 220. Memory 230 may also include a read-only memory (ROM) which may include a conventional ROM device or another type of static storage device that stores static information and instructions for processor 220.

Communication interface 280 may include any mechanism that facilitates communication via a network. For example, communication interface 280 may include a modem. Alternatively, communication interface 280 may include other mechanisms for assisting in communications with other devices and/or systems.

ROM 240 may include a conventional ROM device or another type of static storage device that stores static information and instructions for processor 220. A storage device may augment the ROM and may include any type of storage media, such as, for example, magnetic or optical recording media and its corresponding drive.

User interface 150 may include one or more conventional mechanisms that permit a user to input information to and interact with the image production unit 100, such as a keyboard, a display, a mouse, a pen, a voice recognition device, touchpad, buttons, etc., for example. Output section 130 may include one or more conventional mechanisms that output image production documents to the user, including output trays, output paths, finishing section, etc., for example. The image production section 120 may include an image printing and/or copying section, a scanner, a fuser, etc., for example. The scanner 260 may be any device that may scan documents and may create electronic images from the scanned document. The scanner 260 may also scan, recognize, and decode marking-readable codes or markings, for example. The adjustable feeder tray side guide position sensor 270 may be a contact image sensor (CIS), or a two-dimensional (2D) sensor array, for example.

The image production device 100 may perform such functions in response to processor 220 by executing sequences of instructions contained in a computer-readable medium, such as, for example, memory 230. Such instructions may be read into memory 230 from another computer-readable medium, such as a storage device or from a separate device via communication interface 280.

The operation of the adjustable feeder tray side guide position determination unit 250 will be discussed in relation to the diagram in FIGS. 3A-3C, 4 and 5, and the flowchart in FIG. 6.

Figure 3A:
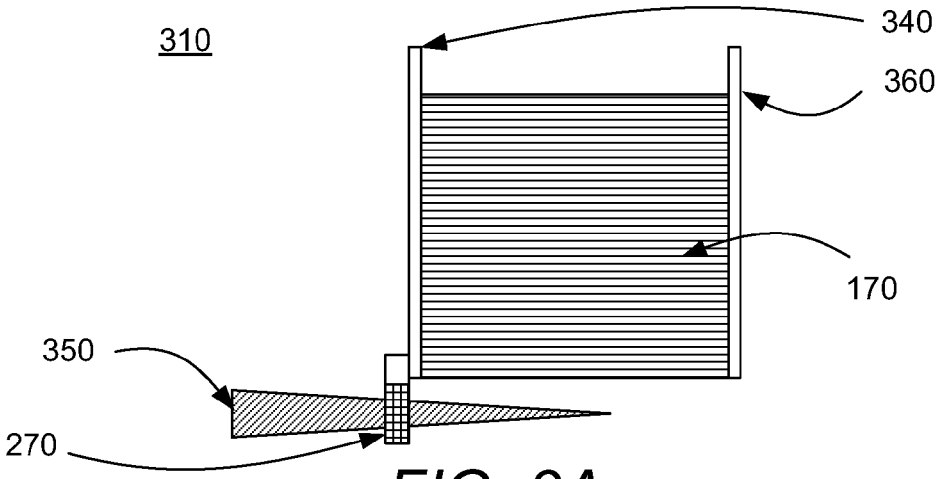
FIGS. 3A-3C are exemplary diagrams of the adjustable feeder tray side guide position determination environment in accordance with one possible embodiment of the disclosure.
Figure 3B:
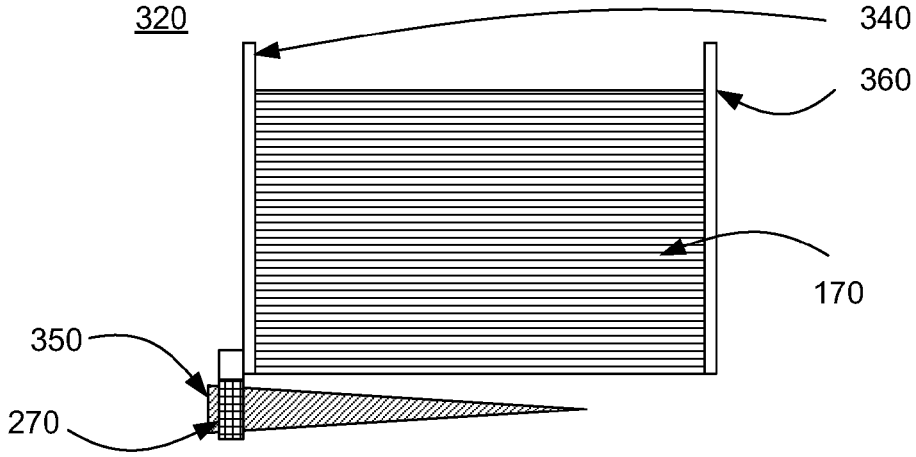
Figure 3C:
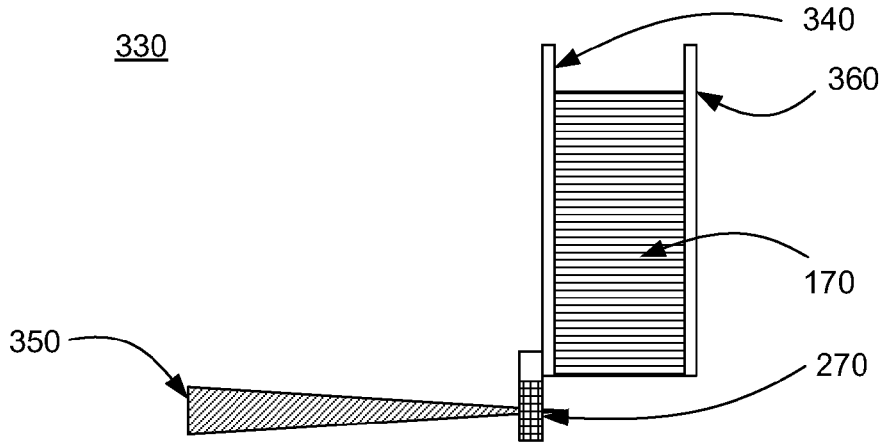
Figure 4:
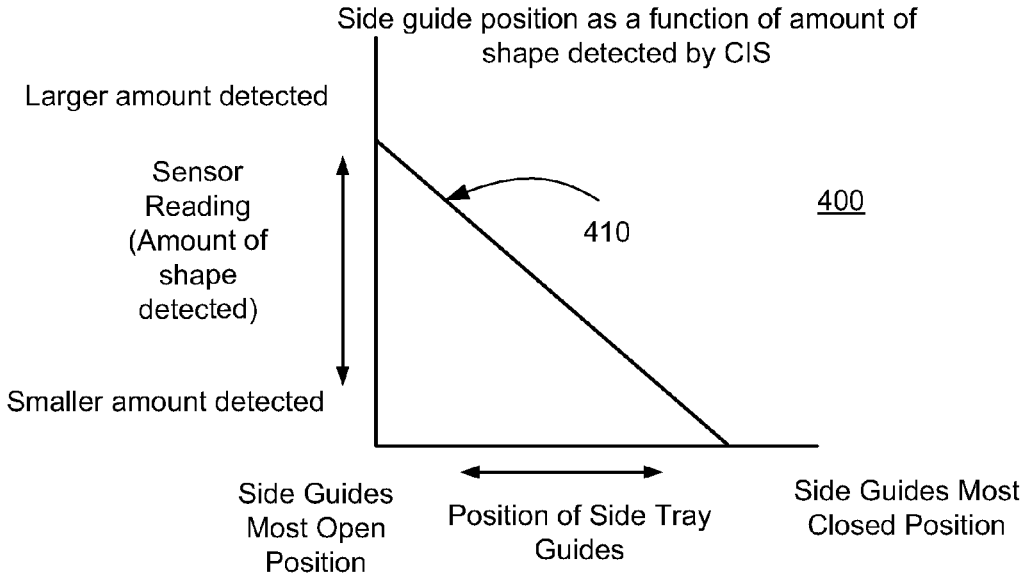
FIG. 4 is an exemplary graph of the adjustable feeder tray side guide position as a function of the amount of shape detected by the adjustable feeder tray side guide position sensor in accordance with one possible embodiment of the disclosure.

FIGS. 3A-3C are exemplary diagrams of the adjustable feeder tray side guide position determination environment in accordance with one possible embodiment of the disclosure. FIGS. 3A-3C each include an adjustable feeder tray side guide 340, a static feeder tray side guide 360, a continuously variable sloped shape marker 350, media 170 stack, and the adjustable feeder tray side guide sensor 270.

FIG. 3A shows the adjustable feeder tray side guide 360 positioned for a medium media sheet width 310, for example. FIG. 3B shows the adjustable feeder tray side guide 360 positioned for a largest sheet width 320 (or media sheet length) allowed by the feeder tray 160, for example. FIG. 3C shows the adjustable feeder tray side guide 360 positioned for a smallest media sheet width 330 allowed by the feeder tray 160, for example.

The continuously variable sloped shape marker 350 may be configured as an isosceles triangle so that the largest area occurs when the side guides are at their widest position. The continuously variable sloped shape marker 350 may be is located on a fixed frame adjacent to the feeder tray 160, for example. Since the largest sheet width 320 in FIG. 3B is at the largest (or approximately the largest) portion of the continuously variable sloped shape marker 350, then the adjustable feeder tray side guide sensor 270 may detect a greater area of the continuously variable sloped shape marker 350. The adjustable feeder tray guide sensor 270 may be attached to the adjustable feeder tray guide 360, for example.

As shown, FIG. 3A detects a "medium" amount of the continuously variable sloped shape marker 350 which may equate to a medium media sheet width and FIG. 3C detects the "smallest" area (or approximately the smallest area) of the continuously variable sloped shape marker 350 which may equate to the smallest media sheet width in this example. This relationship is illustrated in the graph in FIG. 4 and the line 410 with a slope which shows that the larger amount of the continuously variable sloped shape marker 350 detected, the more open the adjustable feeder tray side guide 340 is and consequently, the wider the media in the feeder tray 160 that may be determined by the adjustable feeder tray side guide determination unit 250.

From the detected area, the adjustable feeder tray side guide determination unit 250 may determine the position of the adjustable feeder tray side guide 340 and from that position, determine the width (or length) and/or media type (e.g., 8.5"×11", A4, etc.), for example.

While the continuously variable sloped shape marker 350 is shown so that the largest area occurs when the side guides are at their widest position, the continuously variable sloped shape marker 350 may be configured so that the smallest area occurs when the side guides are at their widest position, for example. Moreover, the continuously variable sloped shape marker 350 may be configured in any manner such that the adjustable feeder tray side guide determination unit 250 may determine the position of the adjustable feeder tray side guide 340 at any point along the continuously variable sloped shape marker 350 within the spirit and scope of the invention.

Note that while the continuously variable sloped shape marker 350 is shown in FIGS. 3A-3C as an isosceles triangle, other continuously variable sloped shapes may be used as known to one of skill in the art, such a right triangle, for example.

Figure 5:
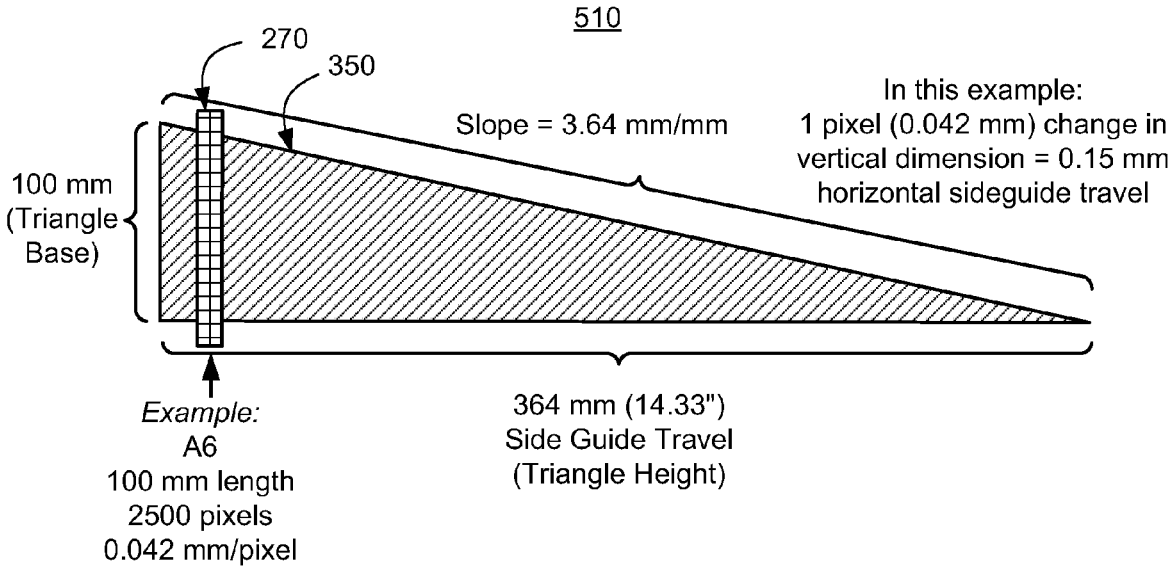
FIG. 5 is an exemplary diagram illustrating the possible detection method that may be used to determine the adjustable feeder tray side guide position in accordance with one possible embodiment of the disclosure.

FIG. 5 is an exemplary diagram illustrating the possible shape detection process 510 that may be used to determine the feeder tray side guide position in accordance with one possible embodiment of the disclosure. As shown in this example, the continuously variable sloped shape marker 350 is a right triangle having a height of 364 mm, a base of 100 mm, and a slope of 3.64 mm/mm. In this example, a 1 pixel (0.042 mm) change in the vertical direction=0.15 mm of horizontal side guide travel. As such, with the adjustable feeder tray side guide position sensor 270 in the position shown on the left hand side (a larger area of the continuously variable sloped shape marker 350 to detect), the adjustable feeder tray side guide position determination unit 250 may determine 100 mm length 2500 pixels at 0.042 mm/pixel. As such, the adjustable feeder tray side guide position determination unit 250 may determine the position of the adjustable feeder tray side guide 340 and from that position, the adjustable feeder tray side guide position determination unit 250 may determine that they feeder tray 160 is holding A6 paper.

Figure 6:
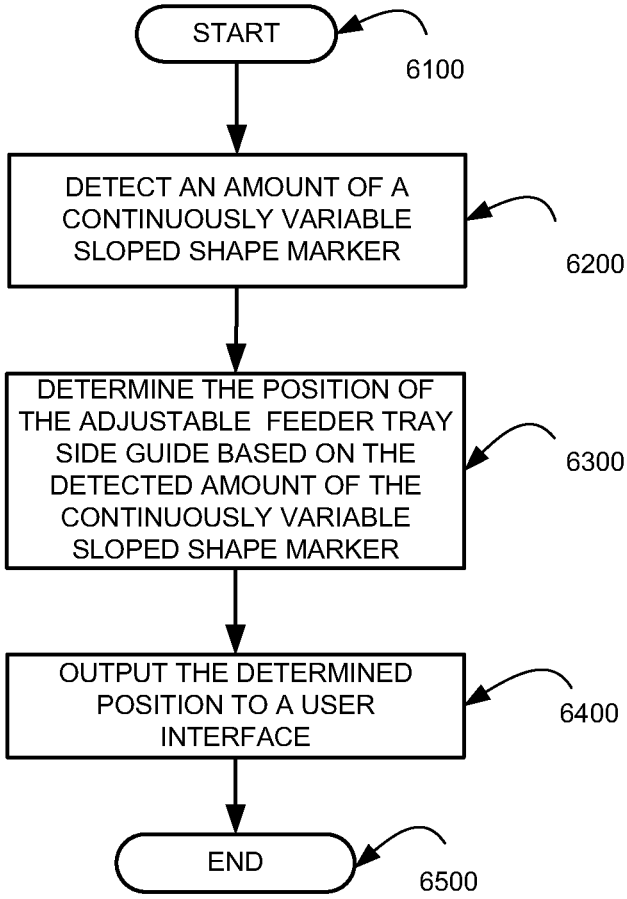
FIG. 6 is a flowchart of an exemplary adjustable feeder tray side guide position determination process in accordance with one possible embodiment of the disclosure.

FIG. 6 is a flowchart of an exemplary adjustable feeder tray side guide position determination process in accordance with one possible embodiment of the disclosure. The method may begin at step 6100, and may continue to step 6200, where the adjustable feeder tray side guide position sensor 270 may detect an amount of a continuously variable sloped shape marker 350.

At step 6300, the adjustable feeder tray side guide position determination unit 250 may determine the position of the adjustable feeder tray side guide 340 of a feeder tray 160 based on the detected amount of the continuously variable sloped shape marker 350. At step 6400, the adjustable feeder tray side guide position determination unit 250 may output the determined position of the adjustable feeder tray side guide 340 of a feeder tray 160 to a user interface 150 of the image production device 100. The process may then go to step 6500 and end.

The adjustable feeder tray side guide position determination unit 250 may also determine either media width or media length (depending on the feeder tray and feeder section 110 based on the determined position of the adjustable feeder tray side guide 360.

The adjustable feeder tray side guide position determination unit 250 may output the determined media width or media length to the user interface 150 of the image production device 100, for example. The adjustable feeder tray side guide position determination unit 250 may also determine the media type, such as 8.5"×11", A4, A6, 3"×5", envelope, postcard, etc., and may output the determined media type to the user interface 150 of the image production device 100, for example.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for determining the position of adjustable feeder tray side guides in an image production device, comprising:

sensing an amount of a continuously variable sloped shape marker using a contact image sensor (CIS), the continuously variable sloped shape marker being non-reflective and in the shape of an isosceles triangle;

determining a position of the adjustable feeder tray side guide of a feeder tray based on the detected amount of the continuously variable sloped shape marker;

determining media width of media in the feeder tray based on the determined position of the adjustable feeder tray side guide; and outputting the determined media width to a user interface of the image production device.

2. The method of claim 1, wherein the continuously variable sloped shape marker is located on a fixed frame adjacent to the feeder tray.

3. The method of claim 1, wherein the sensing is performed by a sensor attached to the adjustable feeder tray side guide.

4. The method of claim 1, wherein the image production device is one of a copier, a printer, a facsimile device, and a multi-function device.

5. An image production device, comprising:

a user interface that displays information to a user;

a continuously variable sloped shape marker, the continuously variable sloped shape marker being non-reflective and in the shape of an isosceles triangle;

an adjustable feeder tray side guide position sensor that senses an amount of the continuously variable sloped shape marker, the adjustable feeder tray side guide position sensor being a contact image sensor (CIS); and an adjustable feeder tray side guide position determination unit that determines a position of the adjustable feeder tray side guide of a feeder tray based on the detected amount of the continuously variable sloped shape marker, determines media width of media in the feeder tray based on the determined position of the adjustable feeder tray side guide, and outputs the determined media width to the user interface of the image production device.

6. The image production device of claim 5, wherein the continuously variable sloped shape marker is located on a fixed frame adjacent to the feeder tray.

7. The image production device of claim 5, wherein the adjustable feeder tray side guide position sensor is attached to the adjustable feeder tray side guide.

8. The image production device of claim 5, wherein the image production device is one of a copier, a printer, a facsimile device, and a multi-function device.

9. A computer-readable medium storing instructions for determining the position of adjustable feeder tray side guides in an image production device, the instructions comprising:

sensing an amount of a continuously variable sloped shape marker using a contact image sensor (CIS), the continuously variable sloped shape marker being non-reflective and in the shape of an isosceles triangle;

determining a position of the adjustable feeder tray side guide of a feeder tray based on the detected amount of the continuously variable sloped shape marker; and determining media width of media in the feeder tray based on the determined position of the adjustable feeder tray side guide; and outputting the determined media width to a user interface of the image production device.

10. The computer-readable medium of claim 9, wherein the continuously variable sloped shape marker is located on a fixed frame adjacent to the feeder tray.

11. The computer-readable medium of claim 9, wherein the sensing is performed by a sensor attached to the adjustable feeder tray side guide.

12. The computer-readable medium of claim 9, wherein the image production device is one of a copier, a printer, a facsimile device, and a multi-function device.

* * * * *